US007882972B2

(12) United States Patent
Inomata

(10) Patent No.: US 7,882,972 B2
(45) Date of Patent: Feb. 8, 2011

(54) TIP-RESISTANT BEVERAGE CONTAINER

(75) Inventor: Manabu Inomata, Tokyo (JP)

(73) Assignee: The Coca-Cola Company, Atlanta, GA (US)

( * ) Notice: Subject to any disclaimer, the term of this patent is extended or adjusted under 35 U.S.C. 154(b) by 814 days.

(21) Appl. No.: 11/727,676

(22) Filed: Mar. 28, 2007

(65) Prior Publication Data

US 2008/0237180 A1 Oct. 2, 2008

(51) Int. Cl.
*B65D 1/46* (2006.01)

(52) U.S. Cl. ..... 215/381; 215/382; 220/666; 220/669

(58) Field of Classification Search ..... 215/379, 215/381, 382, 900; 220/672, 675, 666, 669
See application file for complete search history.

(56) References Cited

U.S. PATENT DOCUMENTS

| | | | | |
|---|---|---|---|---|
| 5,531,336 | A * | 7/1996 | Parham et al. | 211/183 |
| 5,788,090 | A | 8/1998 | Kajiwara | |
| 5,971,184 | A * | 10/1999 | Krishnakumar et al. | 215/384 |
| 5,992,650 | A * | 11/1999 | Lord | 211/59.2 |
| 6,749,075 | B2 * | 6/2004 | Bourque et al. | 215/384 |
| 7,014,056 | B2 * | 3/2006 | Trude | 215/381 |
| 7,051,890 | B2 * | 5/2006 | Onoda et al. | 215/383 |
| 2002/0158038 | A1 * | 10/2002 | Heisel et al. | 215/382 |
| 2006/0108317 | A1 * | 5/2006 | Tanaka et al. | 215/382 |
| 2006/0157438 | A1 * | 7/2006 | Livingston et al. | 215/381 |
| 2006/0261030 | A1 * | 11/2006 | Manderfield, Jr. | 215/376 |
| 2007/0039918 | A1 * | 2/2007 | Lane et al. | 215/381 |
| 2008/0000867 | A1 * | 1/2008 | Lane et al. | 215/10 |

FOREIGN PATENT DOCUMENTS

| | | |
|---|---|---|
| JP | 08-299121 | 11/1996 |
| JP | 2008 299121 A | 11/1996 |
| JP | 2000 344220 | 12/2000 |
| JP | 2001-048147 | 2/2001 |
| JP | 2005-81641 | 3/2005 |
| WO | WO 2004/094261 A1 | 11/2004 |
| WO | WO 2007/127789 A1 | 11/2007 |

OTHER PUBLICATIONS

International Search Report and Written Opinion from PCT/US2008/003967, issued Jul. 8, 2008.

* cited by examiner

*Primary Examiner*—Sue A Weaver
(74) *Attorney, Agent, or Firm*—Finnegan Henderson Farabow Garrett & Dunner LLP

(57) ABSTRACT

A beverage container that is prevented from tipping is provided. The beverage container includes a main unit configured to contain liquid therein, the main unit having a front surface, a bottom end, and a fall-stopping surface formed on the front surface of the main unit, the fall-stopping surface being located at a predetermined position in a range of 20 mm to 70 mm from the bottom end, the fall-stopping surface being located at a position in a front-to-back direction the same as or in front of a surface below the fall-stopping surface.

13 Claims, 10 Drawing Sheets

(A)

(B)

COMPARATIVE ART

COMPARATIVE ART

TIP-RESISTANT BEVERAGE CONTAINER

Field of the Invention

The present invention relates to a plastic beverage container or bottle for storing liquids such as soft drinks or the like.

BACKGROUND OF THE INVENTION

Plastic bottles, such as PET bottles, are widely known as beverage containers. Bottles are sold in sizes ranging from compact sizes of 500 ml to medium sizes of around 1000 ml and up to large sizes of 1500-2000 ml.

Generally in stores such as supermarkets, large bottles are placed on display shelves maintained in a horizontal position. Display shelves for compact bottles, on the other hand, have a slope or a slope with rollers. Therefore when a bottle (merchandise) displayed on a display shelf is removed by a consumer, the bottles in rear rows are caused to slide to forward rows under their own weight. A stopper is normally installed at the front surface of the display shelf, and a bottle sliding down stops at the front surface of the display shelf when the bottom portion of the bottle main unit contacts the stopper. (See, e.g., Japanese Published Patent Application H08-299121.)

Bottles have a variety of designs with respect to height, shape, and the like. The height of a compact bottle is designed at 218 mm, for example, to match the height of a multi-level display shelf. On the main unit of a soft drink bottle there are generally ribs formed in order to increase aesthetic appeal or mechanical strength, and decompression absorption panels are concavely formed in order to suppress deformation due to decompression of contents. (See, e.g., Japanese Published Patent Applications 2005-81641 and 2001-48147.) Bottles in which the bottle main unit has a complex shape continue to be developed based on consumer aesthetic tastes.

There are conventional bottles which take into account aesthetics, bottle strength, and the like. However, no consideration has been given to bottle shapes that prevent the bottles from overturning or tipping when displayed in a store. As a result, there is a risk, depending on bottle shape, that a bottle can tip forward due to the shock of hitting the stopper when the bottle slides down from a rear row to a front row on a display shelf and fall over within the display shelf. Such falls can occur not only when a bottle is removed by a consumer, but also when bottles are being replenished from the rear of the display shelf.

In particular, there is a risk that on bottles with a concave decompression absorption panel in a position corresponding to the top end portion of a stopper, the bottom portion of the bottle may contact the mid portion or the bottom portion of the stopper before contacting the top portion of the stopper. When contact of this type occurs, a comparatively large momentum acts on the bottle, making it easy for the bottle to fall over.

SUMMARY OF THE INVENTION

It is accordingly an object of the invention to provide a plastic bottle that does not fall even in the case of unstable bottles with small overturn angles.

A beverage container includes a main unit configured to contain liquid therein, the main unit having a front surface, a bottom end, and a fall-stopping surface formed on the front surface of the main unit, the fall-stopping surface being located at a predetermined position in a range of 20 mm to 70 mm from the bottom end, the fall-stopping surface being located at a position in a front-to-back direction the same as or in front of the surface below the fall-stopping surface.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE EMBODIMENTS

Figure 1:
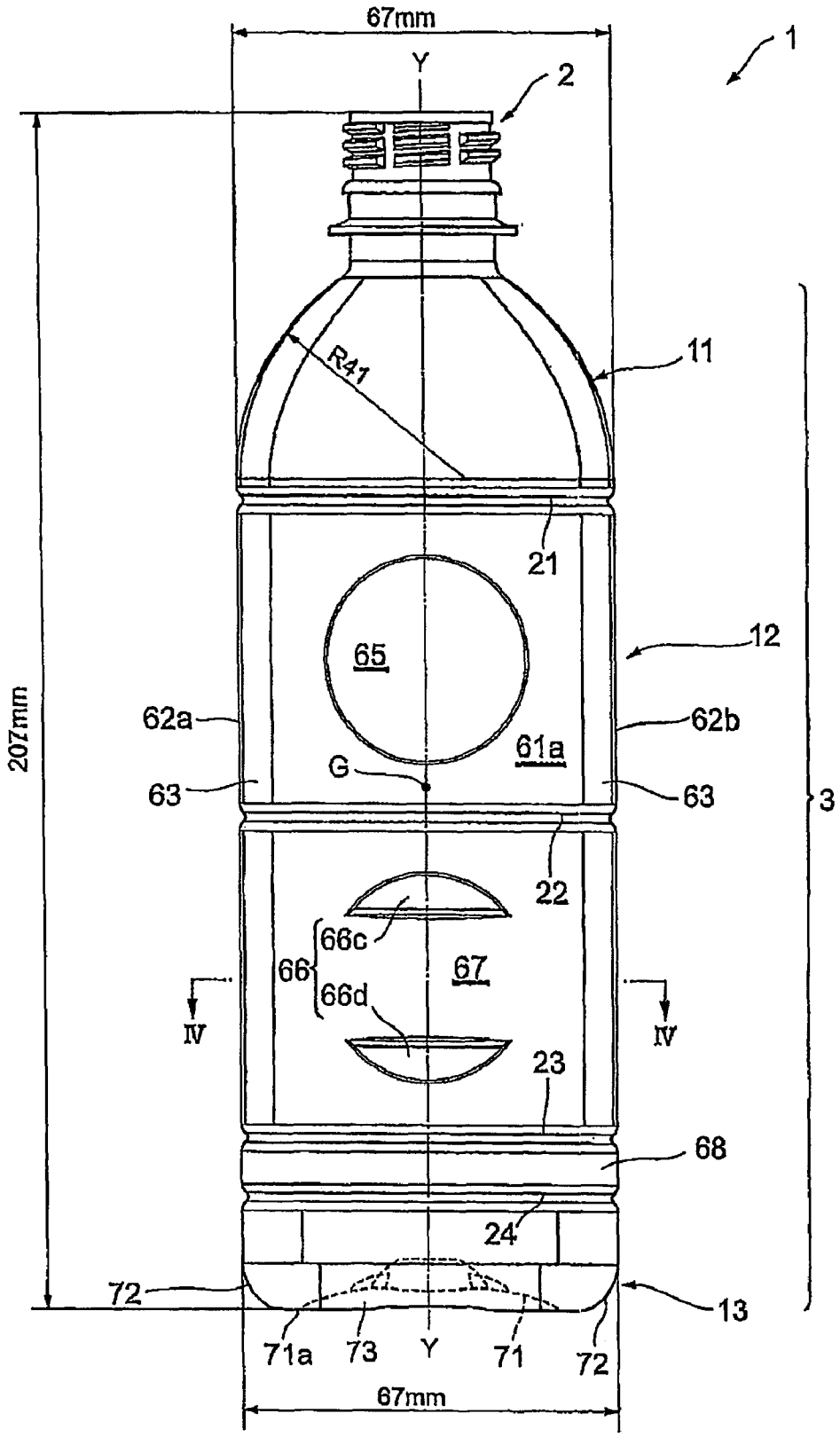
FIG. 1 is a front view of a plastic bottle according to an embodiment of the invention.

A beverage container includes a main unit configured to contain liquid therein, the main unit having a front surface, a bottom end, and a fall-stopping surface formed on the front surface of the main unit, the fall-stopping surface being located at a predetermined position in a range of 20 mm to 70 mm from the bottom end, the fall-stopping surface being located at a position in a front-to-back direction the same as or in front of a surface below the fall-stopping surface.

The height of the stopper on a display shelf on which bottles are displayed is frequently set to between 20 mm and 70 mm. In one embodiment, a fall-stopping surface is formed at a predetermined position within this range, and is formed so that the position thereof in the front-to-back direction is not allowed to protrude beyond the lower surface. A fall-stopping surface is thus at the least included in the portion where the bottle contacts the stopper, such that a bottle fall can be prevented when bottles are displayed. Also, a "surface" rather than a "point" is secured as the area of contact with the stopper, thus enabling the impact load to be distributed upon impact with the stopper.

In one embodiment, a decompression absorption panel is preferably concavely formed in the main unit, and the fall-stopping surface is formed in a band shape so as to divide the decompression absorption panel into bottom and top portions.

There are cases with respect to the shape of the main unit in which there is no alternative to forming the concave decompression absorption panel in a position corresponding to the stopper. However, the fall-stopping surface can effectively prevent bottle falls while securing the decompression absorption effect inherently offered by a decompression absorption panel even in such cases.

It may be more preferable for the fall-stopping surface to be flush with other surfaces of the main unit, excluding the decompression absorption panel. With this configuration, it may not be necessary to cause only the fall-stopping surface to project from the main unit.

In one embodiment, reinforcing concave ribs are preferably formed around the periphery of the main unit on at least the upper side and the lower side of the fall-stopping surface. With this configuration, the portion close to the load operating point upon impact with the stopper can be reinforced by concave ribs.

The fall-stopping surface preferably has a height in the vertical direction of 10 mm to 30 mm. With this configuration, the fall-stopping surface can contact the stopper even in cases where there are variations in stopper height due to the display shelf.

The fall-stopping surface preferably curves away from the bottle. In this configuration, the distance from the bottle center of gravity position to the fall-stopping surface is greater compared to the case in which the fall-stopping surface does not curve, thereby enabling an even greater prevention of bottle overturn.

In one embodiment, the main unit preferably has an approximately rectangular sectional shape in which the length in the left-to-right direction is greater than the length in the front-to-back direction. In this configuration, bottles having an oblate main unit can be prevented from falling at the time of display.

More preferably, the fall-stopping surface is formed to extend in a left-right [lateral] direction at the center portion of the front surface of the main unit. The fall-stopping surface may make broad contact with the stopper when it impacts the stopper, thereby distributing the impact load.

In one embodiment, the center of gravity position of the bottle in a liquid holding state is preferably higher than the fall-stopping surface.

The bottle is preferably one which is displayed on a display shelf with a stopper, and when the bottle impacts the stopper, the fall-stopping surface contacts the stopper at the same time or earlier than does the surface of the main unit, which is below the fall-stopping surface.

Also, preferably, bottle capacity is between 300 ml and 800 ml, and bottle height is between 140 mm and 220 mm.

In another embodiment, a plastic bottle may be displayed on a display shelf with a stopper. The bottle has a main unit configured to store liquid therewithin, and a fall-stopping surface formed on the main unit at a position corresponding to the stopper and extending in the width direction of the plastic bottle.

Figure 2:
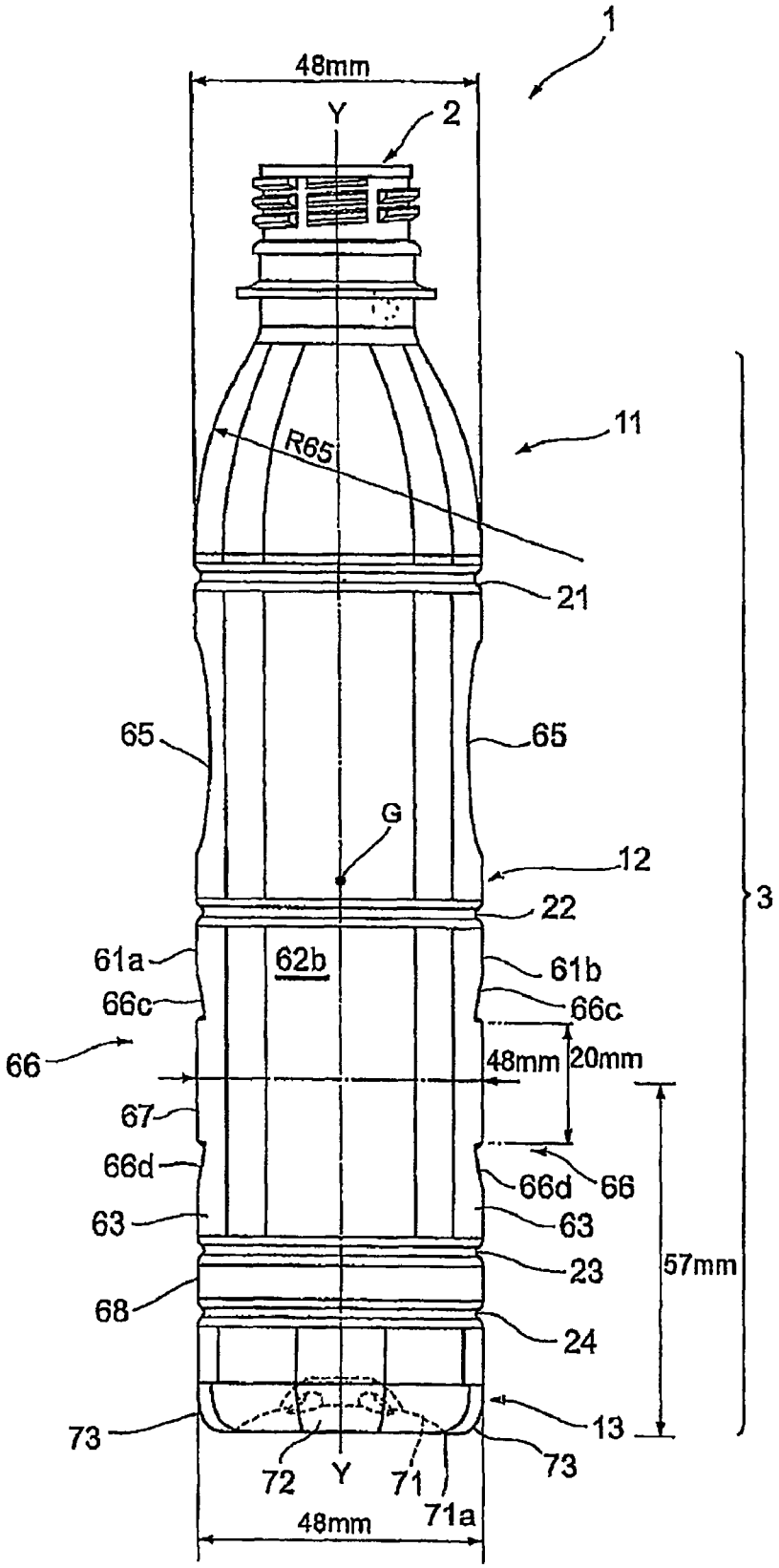
FIG. 2 is a side view of the plastic bottle in FIG. 1.

As shown in FIGS. 1 and 2, a plastic beverage container or bottle 1 (referred to below simply as "bottle 1") has a spout portion 2 and a main unit 3, and is formed in an overall oblate shape. The bottle 1 is formed by stretch blow molding using a thermoplastic resin such as polyethylene, polypropylene, or polyethylene terephthalate as a primary material. Injection blow molding by the cold parison method, for example, is used for the stretch molding method. This molding method should be well known to one skilled in the art, and a detailed explanation thereof is omitted, and only a brief explanation of a parison used in the cold parison method is described.

Figure 5:
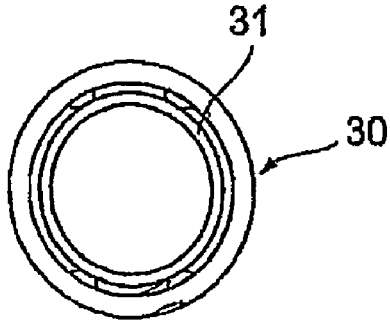
FIG. 5(A) is a plan view of a plastic bottle parison according to one embodiment.
FIG. 5(B) is a cross-sectional view of the plastic bottle parison in FIG. 5(A)
Figure 5:
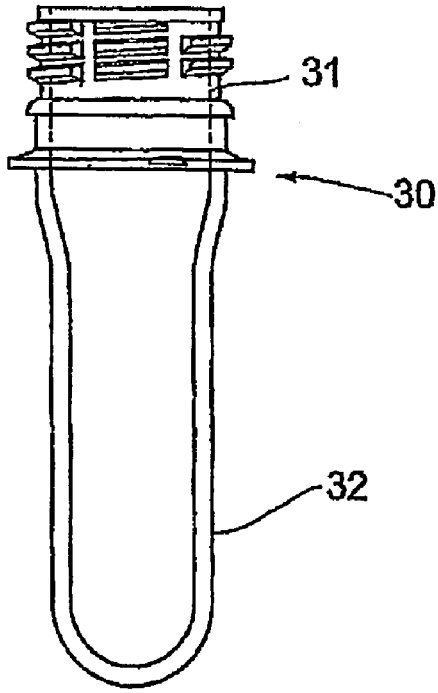

As illustrated in FIG. 5, a parison 30 has a spout portion 31 and a main unit preform portion 32 extending to the bottom edge of the spout portion 31. A spout portion 31 has exactly the same shape as the spout portion 2. The main unit preform portion 32 is ultimately molded onto the main unit 3. The spout portion 31 and the main unit preform portion 32 are formed to be circular in section. Under the cold parison method, only the main unit preform portion 32 of the parison 30 is heated, and the bottom portion thereof is stretched. The main unit preform portion 32 expands as a result of blowing in compressed air and adheres to the inner wall of the mold, after which it is cooled and solidified. A bottle 1 with a uniform thickness is thus molded.

After molding, the bottle 1 undergoes cleaning and sterilization using chlorine-based microbicides or the like, and is filled with a beverage. Japanese tea, oolong tea, black tea, coffee, juice, and various other non-carbonated drinks are examples of such beverages. Since for non-carbonated drinks the internal pressure of the bottle is generally a negative pressure (i.e. lower than the outside pressure), bottle strength is weak, and concave ribs are formed in the bottle to assure that strength. The bottle 1 of the present embodiment has reinforcing concave ribs (concave ribs 21-24 described below), and is therefore suitable for filling with non-carbonated drinks. In other embodiments, however, the liquid used to fill the bottle 1 may be a carbonated drink, or could even be a food product such as sauce, mirin [sweet sake for seasoning], or the like.

Certain terms used in this specification are defined as below.

"Center axis Y-Y direction" refers to the up-down direction of the bottle 1. "Bottle inward direction" refers to the direction approaching the center axis Y-Y past the bottle wall, and "bottle outward direction" refers to the direction going away from the center axis Y-Y beyond the bottle wall. The bottle "width," "depth," and "height" refer respectively to the bottle 1 lengths in the left-right direction, the front-to-back direction, and the up-down direction. "Cross-sectional shape" means the sectional shape of the bottle 1 in a plane perpendicular to the center axis Y-Y. "Peripheral direction" means the direction revolving around the profile of the cross-sectional shape. "Oblate" refers to the fact that the length of one side of the cross-sectional shape is not equal to the length of the other side which crosses it is perpendicular thereto. "Oblate ratio" refers to the ratio of the width and the depth in the cross-sectional shape.

According to one embodiment, the size of the bottle 1 may be as follows. First, the height of the bottle 1 may be between 140 mm and 220 mm. This is because the height of display shelves installed in vending locations such as supermarkets or convenience stores is often designed to be able to align merchandise, which for compact sized products is 230 mm high. Next, the capacity of the bottle 1 may be 300 ml to 800 ml, preferably 300 ml to 500 ml. That is because with this size it is possible to offer a relatively compact size of oblate bottle. The height, capacity, maximum width, maximum depth, and oblate ratios of the embodied bottles 1 described below may be approximately 207 mm, approximately 450 ml, approximately 67 mm, approximately 48 mm, and approximately 1.4, respectively.

Figure 3:
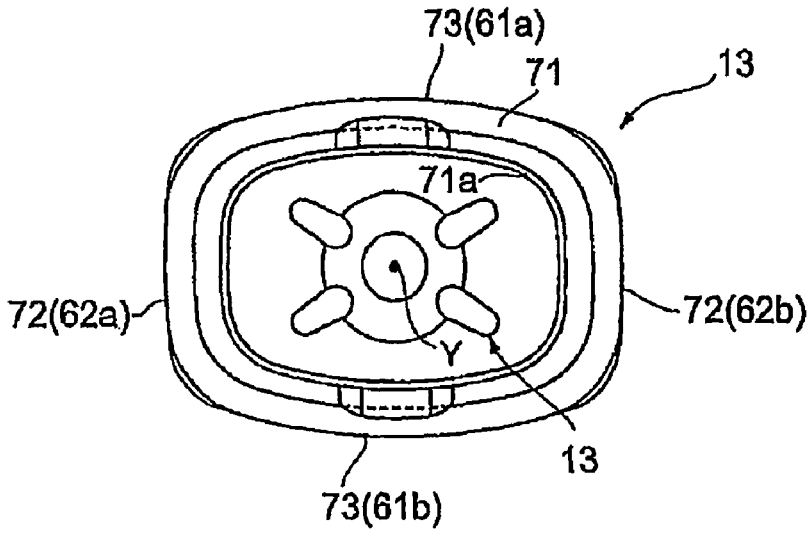
FIG. 3 is a bottom view of the plastic bottle in FIG. 1.

Each portion of the bottle 1 is now explained in reference to FIGS. 1 through 3.

The spout portion 2 is positioned on the top end portion of the bottle 1, and constitutes the smallest diameter portion of the bottle 1. The spout portion 2 is open at the top, and functions as a drink supply spout, a drinking spout, a pour spout, and a spill spout. The spout portion 2 opening is opened and closed by a cap, which is not shown in the diagram.

In sequence from the center axis Y-Y, the main unit 3 has a shoulder portion 11, a trunk portion 12, and a bottom portion 13. The shoulder portion 11, trunk portion 12, and bottom portion 13 constitute a bottle wall capable of storing a drink therewithin. When the inside of the main unit 3 is filled with a beverage, the bottle center of gravity G is positioned approximately 87 mm from the bottom end of the bottle 1.

As shown in FIG. 1, the main unit 3 has four mutually parallel concave ribs 21, 22, 23, and 24. The concave ribs 21, 22, 23, and 24 are formed as inward depressions on the bottle over the periphery of the main unit 3. In the exemplary embodiment, concave ribs are formed in a well balanced manner in the trunk portion 12. The concave rib 21 increases the lateral rigidity at the top end of the trunk portion 12; the concave rib 22 increases the lateral rigidity of the mid-portion of the trunk portion 12, and the concave ribs 23 and 24 increase the lateral rigidity of the bottom portion of the trunk portion 12. The lateral rigidity of the bottle 1 can thus be increased without degrading the decompression absorption effect of the decompression absorption panels 65 and 66 discussed below. Note that the sectional shapes of each of the concave ribs can be appropriately designed in the vertical section as semicircular arcs, trapezoids, or the like.

The shoulder portion 11 continues to the bottom portion of the spout portion 2. The shoulder portion 11 is formed in the slope-shouldered shape of the front view in FIG. 1. The oblate ratio thereof varies over the vertical direction. In the shoulder portion 11, the curvature radius R of the side wall extending in the depth direction is approximately 41 mm, and the curvature radius R of the side wall extending in the width direction is approximately 65 mm. A border is defined by the concave rib 21 between the shoulder portion 11 and the trunk portion 12.

In order to give strength to the bottle 1, the bottom portion 13 includes an upwardly convex bottom surface 71. A surface 71*a*, elliptically shaped in the bottom view, serves as the surface at which the bottle 1 actually contacts the ground. This surface 71*a* is the reference point for the length of the bottle 1 from the bottom end. On the bottom portion 13, the two edge portions 72, 72 in the width direction are round chamfered as depicted in FIG. 1, and the two edge portions 73, 73 in the depth direction are round chamfered as shown in FIG. 2. Note that "round-chamfered" has the same meaning as "arced," "rounded," or "radiused."

Figure 4:
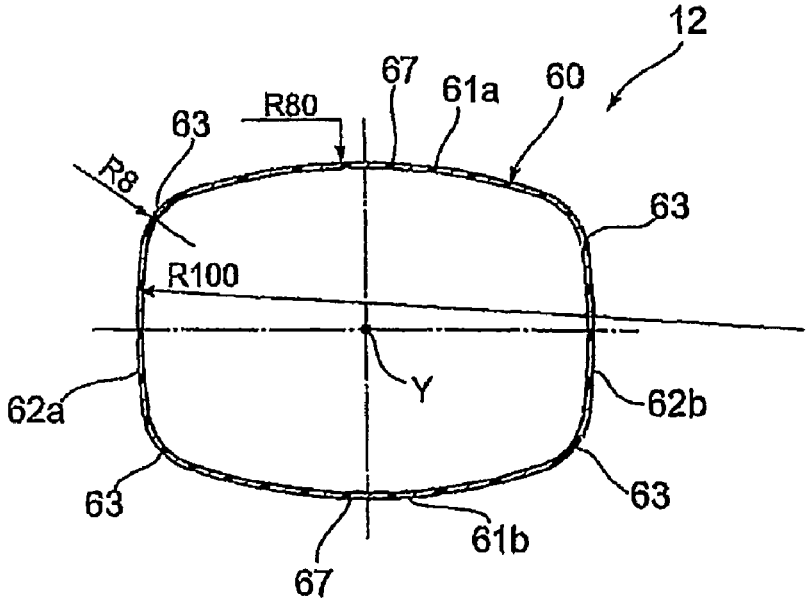
FIG. 4 is a cross-sectional view at the line IV-IV in FIG. 1.

The trunk portion 12 is between the shoulder portion 11 and the bottom portion 13. The trunk portion 12 is formed with left-right and front-to-back symmetry around the center axis Y-Y. As shown in FIG. 4, the trunk portion 12 basic cross sectional shape 60 is approximately a rectangle, in which the length in the left-right direction is longer than the length in the front-to-back direction. That is, the cross sectional shape 60 is oblate, and as described above, the oblate ratio thereof is 1.4 (≈67 mm/48 mm). The oblate ratio of what may be a referred to as oblate trunk portion 12 is approximately 1.2 to 1.8, and preferably 1.3 to 1.6.

The sectional shape 60 comprises four side walls 61*a*, 61*b*, 62*a*, 62*b*. Each of the corners 63 of the sectional shape are round chamfered to a radius R8, for example. The two front-rear side walls 61*a*, 61*b* extend in the width direction of the bottle 1. The two left-right side walls 62*a*, 62*b* are respectively positioned between the side walls 61*a* and 61*b*, and extend in the depth direction of the bottle 1 in such a way as to link these together. The side walls 61*a*, 61*b*, 62*a*, 62*b* are curved to expand outward from the bottle, and the center portions thereof are the furthest expanded outward from the bottle.

The decompression absorption panels 65 and 66 are respectively concavely formed on the side walls 61*a* and 61*b*. The decompression absorption panels 65 and 66 absorb the reduction in internal bottle pressure after filling with a beverage, and have the function of suppressing the deformation of the bottle 1. In particular, side walls 61*a* and 61*b*which are relatively long in the width direction, are more easily distorted by decompression than the side walls 62*a* and 62*b*, which are relatively short in the depth direction, therefore the deformation can be suppressed by the decompression absorption panels 65 and 66. The decompression absorption panel 65 comprises a circle, and the center portion of that circle is formed in the center region of the upper half portion of the side walls 61*a* and 61*b* so as to depress most extensively toward the inside of the bottle.

The decompression absorption panel 66 comprises two approximately bow-shaped parts 66*c* and 66*d* separated above and below, and is formed in the center region of the lower half portion of the side walls 61*a* and 61*b*. The bow-shaped part 66*c* and the bow-shaped part 66*d* are respectively each concavely formed so that the fall-stopping surface 67 side depresses furthest into the bottle. The bow-shaped part 66*c* and 66*d* are part of a panel with the same shape as the decompression absorption panels 65; the outer surface of the remainder of this panel is the fall-stopping surface 67, which extends in a belt shape in the width direction. Stated differently, the fall-stopping surface 67 divides a circular decompression absorption panel, which is the same as the decompression absorption panel 65, into upper and lower portions, and crosses the center portion of the decompression absorption panel in the width direction so as to describe bow-shaped parts 66*c* and 66*d*.

The fall-stopping surface 67 is the location which impacts the stopper 102 on the display shelf 100 (see FIG. 6) and functions to stop the bottle 1 from falling over at the time of impact. It is therefore preferable to design the fall-stopping surface 67 position, size, and range with consideration for the height of the stopper 102. The height of the stopper 102 is often set in a range from 20 mm to 70 mm; within this range, 20 mm and 50 mm are common settings. It is therefore sufficient for the center position of the fall-stopping surface 67 to be at a predetermined position in a range from 20 mm to 70 mm from the bottom end of the bottle 1. An example of the case in which the height of the stopper 102 is 50 mm is explained below.

The fall-stopping surface 67, as depicted in FIG. 2, preferably has a height of between 10 mm and 30 mm in the center axis Y-Y direction; here it has a height of approximately 20 mm. It is sufficient for the length from the bottom end of the bottle 1 to the center position of the fall-stopping surface 67 height to be higher than the height of the stopper 102; here it is approximately 57 mm. Using this type of dimensional setting, the fall-stopping surface 67 can have a range of approximately 47 mm to approximately 67 mm distance from the bottom end of the bottle 1.

The fall-stopping surface 67, as depicted in FIG. 1, extends in the left-right direction in the center region of the lower half of the side walls 61*a* and 61*b*, and both ends in the left-right direction connect steplessly to other surfaces of the trunk portion 12. In other words, the fall-stopping surface 67 is flush with the other surfaces of the trunk portion 12 except for the decompression absorption panel 66. Also, as depicted in FIG. 2, the depth of the part of the trunk portion 12 in which the fall-stopping surface 67 exists is equal to the maximum depth of 48 mm. That is, the fall-stopping surface 67 is in the same position as the surface 68, which is underneath the fall-stopping surface 67. Moreover, as shown in FIG. 4, the fall-stopping surface 67 may be the same surface as the exterior surface of a portion of the basic cross sectional shape 60.

It is sufficient for the fall-stopping surface 67 to be in a position corresponding to the stopper 102, therefore it may not be necessary to be formed on both surfaces at the front and back of the bottle 1. The fall-stopping surface 67 may be disposed on only the outside surface of the side wall 61*a* which serves as the front surface side of the bottle 1. In that case it is sufficient for the side wall 61*b* decompression absorption panel 66 to have the same shape as the decompression absorption panel 65. In other embodiments, the decompression absorption panels 65 and 66 may be given other shapes such as an ellipse, a rectangle, etc.

Next, referring to FIGS. 6-10, the relationship between the bottle 1 and the display shelf 100 is explained.

Figure 6:
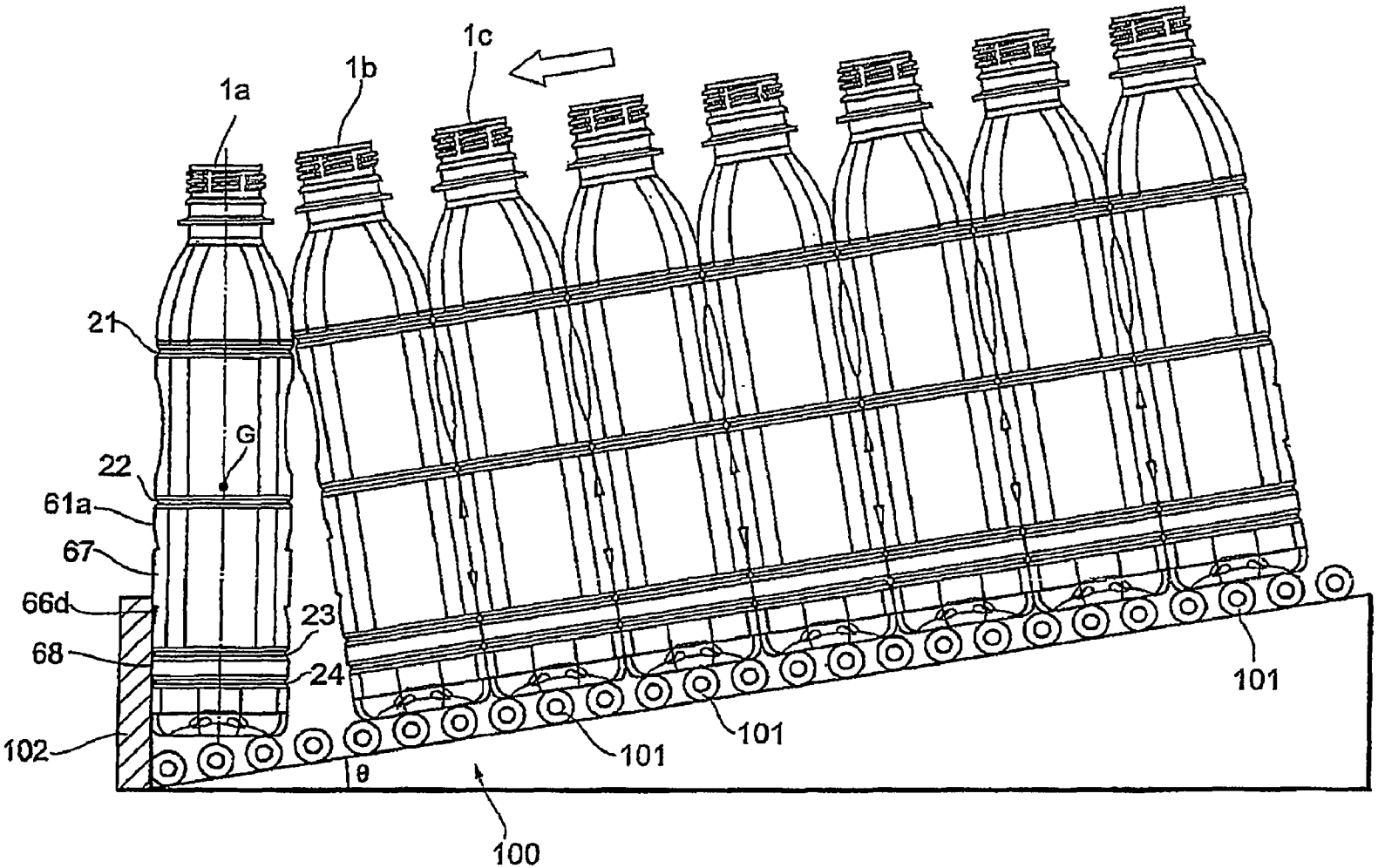
FIG. 6 is a schematic side view of a display shelf with a stopper.

As illustrated in FIG. 6, the display shelf 100 includes a plurality of rollers 101 and a stopper 102. The plurality of rollers 101 are disposed at an angle which slopes downward from the rear toward the front, and are rotatably supported by the shelf main unit (frame), which is not depicted. The angle θ of inclination of the rollers 101 is set, for example, in a range of 3-5 degrees.

The stopper 102 is disposed at the front end portion of the display shelf 100. The height of the stopper 102 is set, as an example, at 50 mm as described above. The stopper 102 is constituted, for example, by a vertically extending plate. The stopper 102 generally also extends horizontally, and the length thereof exceeds the width of the bottle 1. The stopper 102 contacts the bottle 1*a* at the forefront, preventing the bottle 1*a* from falling downward.

In a display shelf 100 wherein a plurality of bottles 1 are displayed on rollers 101, the front bottle 1*a* stops on the rollers 101 without inclining. At this time, a portion of the fall-stopping surface 67 and the surface 68 therebelow on the bottle 1*a* contact the stopper 102. To explain this in more detail, the outer surface of the side wall 61*a*, which is below the fall-stopping surface 67, and the outer surface excluding the concave ribs 23 and 24 and the bow-shaped part 66*d*, contact the stopper 102. At the same time, the bottles 1*b*, 1*c*, . . . behind this bottle 1*a* are inclined at the inclination angle of the rollers 101, and stop on the rollers 101. The adjacently displayed bottles 1*b* and 1*c* mutually contact one another at the outer surfaces in the vicinity of the concave ribs 21-24 and at the fall-stopping surfaces 67.

When the front bottle 1*a* is removed by a consumer, the bottles 1*b*, 1*c*, . . . behind it slide down toward the front (in the direction of the arrow in FIG. 6) under their own weight. This causes the bottom part of a bottle 1*b* to impact the stopper 102, stop, and await the next removal. The display shelf 100 thus has the function of automatically pushing to the front a plurality of displayed bottles 1. The bottles 1 can be replenished (filled) onto the display shelf 100 by feeding the bottles 1 onto the rollers 101 from the rear of the display shelf 100.

Figure 7:
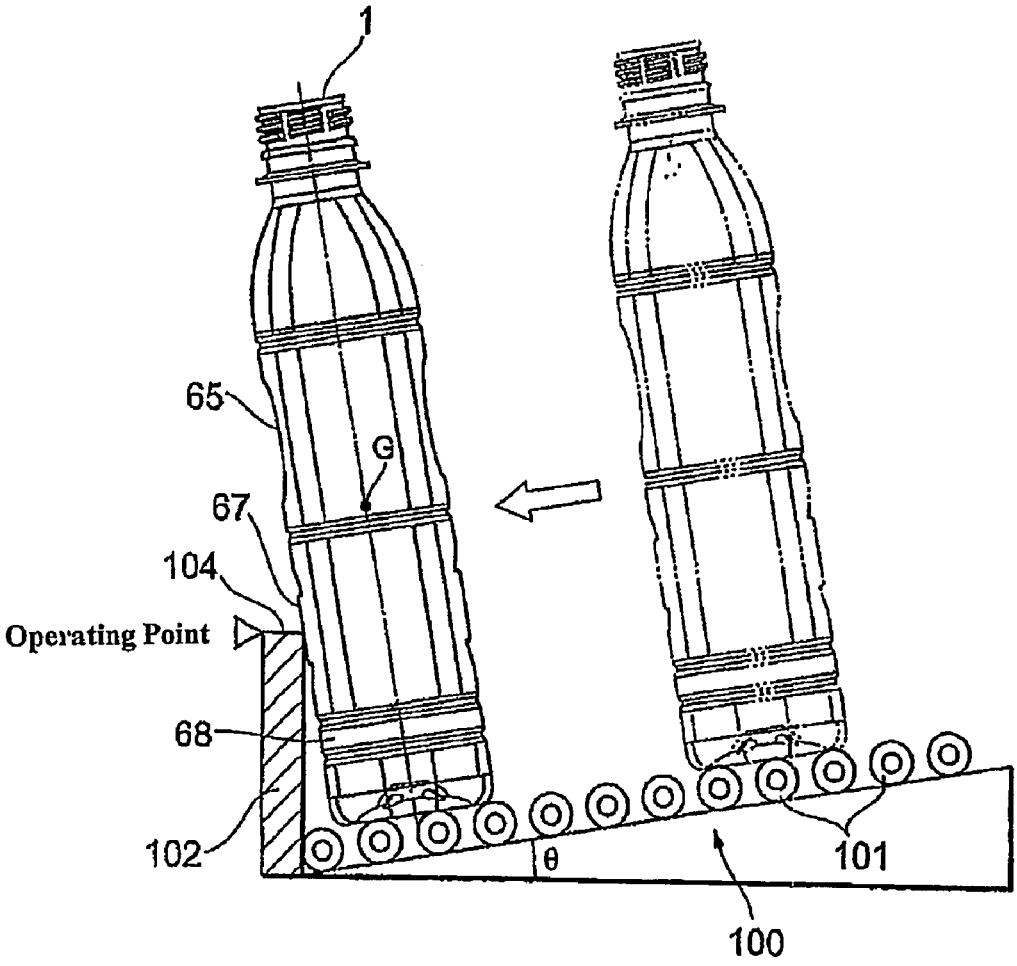
FIG. 7 is a schematic side view of a display shelf when a plastic bottle according to one embodiment impacts a stopper.
Figure 8:
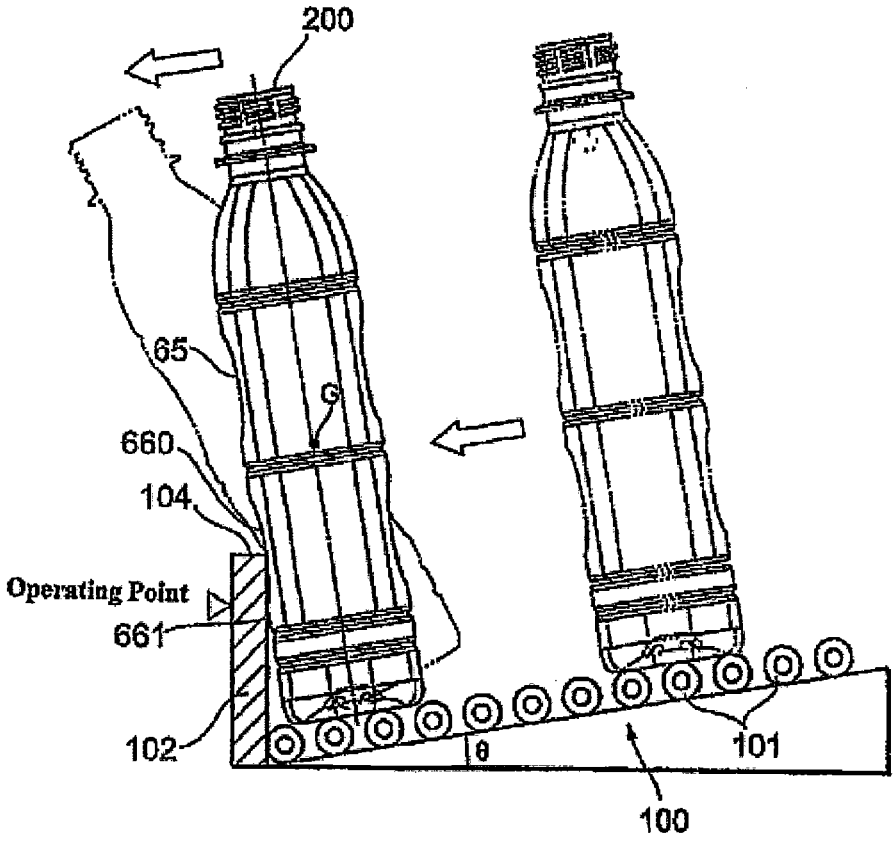
FIG. 8 is a schematic side view of a display shelf when a plastic bottle according to a comparative example impacts a stopper.

Referring to FIGS. 7 and 8, the effect of the fall-stopping surface 67 when a bottle 1 is removed or filled is explained. FIG. 7 depicts an embodiment bottle 1; FIG. 8 depicts a bottle 200 in a comparative example. The difference between the bottle 1 and the bottle 200 is that in the bottle 200, the part corresponding to the fall-stopping surface 67 on the bottle 1 comprises a decompression absorption panel 660 of the same concave shape as the decompression absorption panel 65. Note that the centers of gravity G of the bottle 1 and the bottle 200 are in approximately the same positions, and both are in a position higher than the height of the stopper 102.

As depicted in FIG. 7, when the embodiment bottle 1 slides down and impacts the stopper 102, the fall-stopping surface 67 contacts the top end portion 104 of the stopper 102. In other words, the fall-stopping surface 67 contacts the top end portion 104 before the surface 68 below the fall-stopping surface 67 does so. Therefore the operating point on the bottle 1 at the time of impact is the fall-stopping surface 67, which is contacted by the top end portion 104.

At the same time, when the bottle 200 in the comparative example slides down and contacts the stopper 102 as shown in FIG. 8, the outside surface 661 on the lower side of the decompression absorption panel 660 contacts the stopper 102. This is because at the time of impact, the top end portion 104 is positioned within the concave portion of the decompression absorption panel 660. As a result, the operating point on the bottle 1 at the time of impact is the outside surface 661, which makes contact at a part below the top end portion 104.

Therefore the distance between the center of gravity G and the operating point is longer in the bottle 200, and a comparatively large momentum operates at the time of impact, making it easier for the upper portion of the bottle 200 to incline forward. Under this circumstance, the lower portion of the bottle 200 slides up in a backward direction due to the operation of the rollers 101, and the bottle 200 falls over in the display shelf 100. In response, the distance between the center of gravity G and the operating point can be shortened in the bottle 1 as compared to the bottle 200, so that the application of a comparatively large momentum at the time of impact can be avoided. Falling over of bottles 1 in the display shelf 100 can thus be suppressed.

Figure 9:
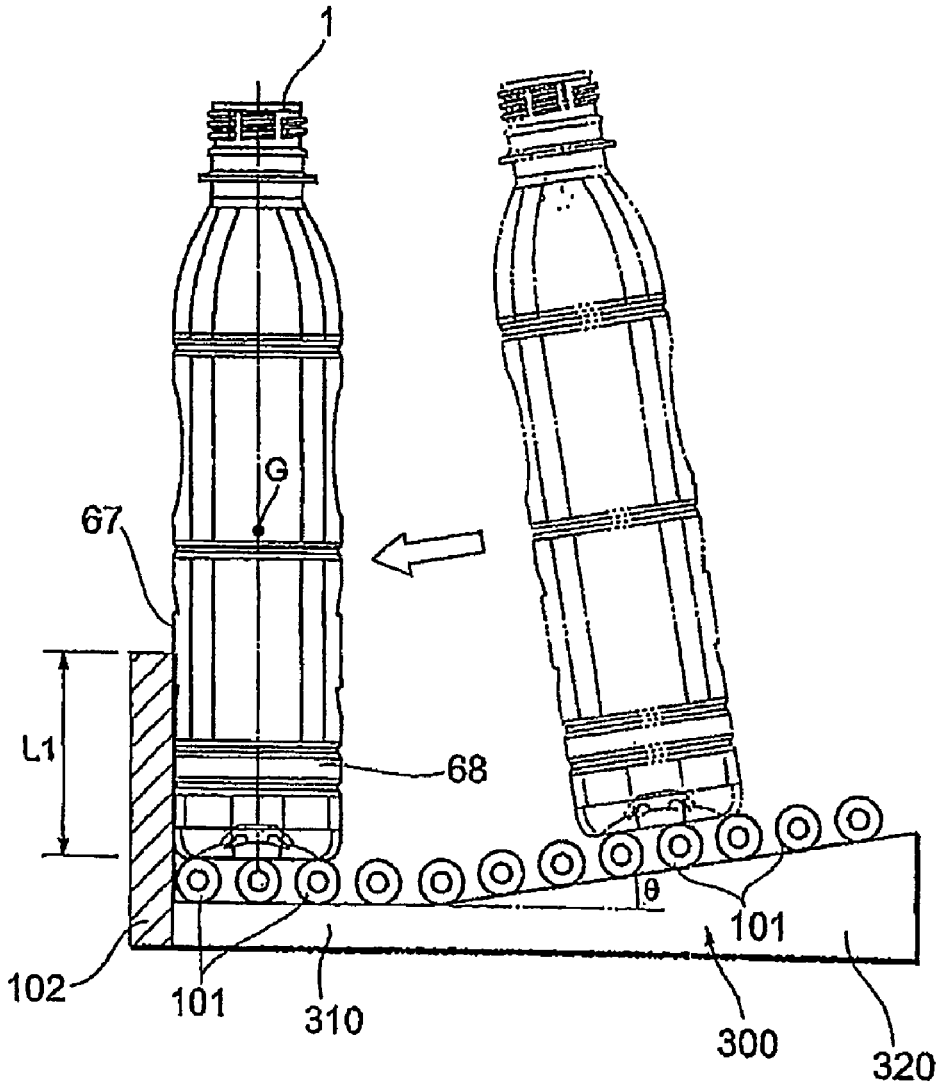
FIG. 9 is a side view of another display shelf when a plastic bottle according to one embodiment impacts a stopper.
Figure 10:
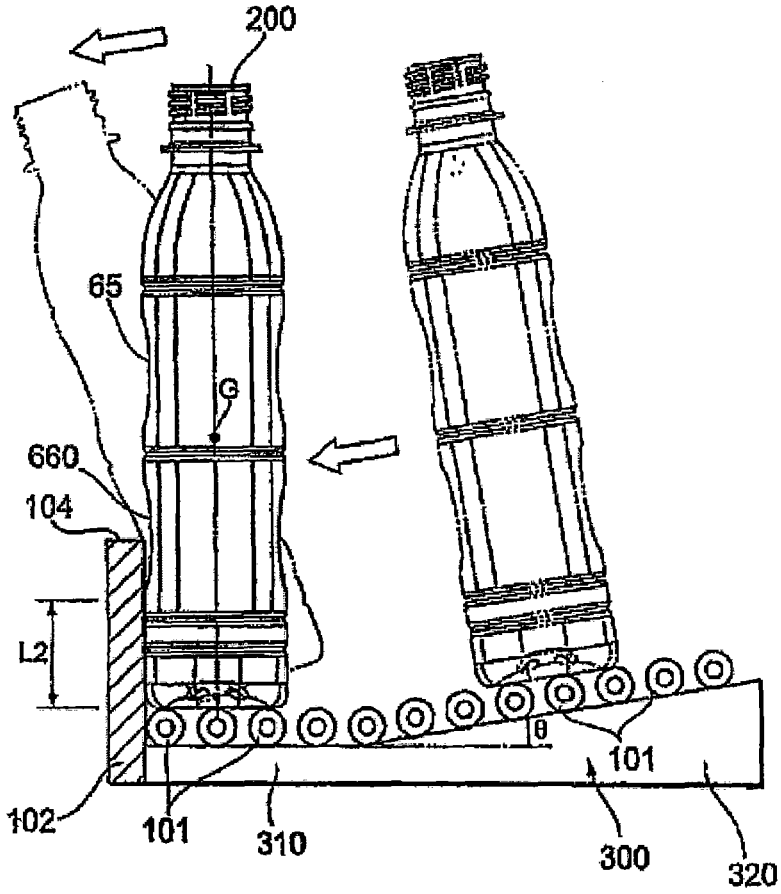
FIG. 10 is a side view of another display shelf when a plastic bottle according to a comparative example impacts a stopper.

Next, referring to FIGS. 9 and 10, the effect of the fall-stopping surface 67 in another display shelf embodiment 300 is explained. Where possible, the same reference numerals are used.

In the display shelf 300, a front portion 310 on the bottle removal side is disposed horizontally over just a length corresponding to the depth of a single bottle 1. That is, rollers 101 disposed on the front portion 310 do not incline from the front to the rear. At the same time, rollers 101 disposed in another area 320 do incline at an angle θ as described above. Therefore during removal or filling, the bottles 1 which slide down toward the front portion 310 contact the stopper 102 in an upright state.

As depicted in FIG. 9, when a bottle 1 impacts the stopper 102, the fall-stopping surface 67 contacts the stopper 102 at the same time as does the surface therebelow (68). The vertical length of that contacting area is L1. Meanwhile, when a bottle 200 impacts the stopper 102 as illustrated in FIG. 10, the part corresponding to the decompression absorption panel 660 (the top end portion 104) does not contact the stopper 102. For this reason the length L2 of the contact area in the FIG. 10 case is shorter than the length L1. Therefore as in the case of the display shelf 100, a bottle 200 can easily fall over within the display shelf 300 when it impacts the stopper 102, but compared to the bottle 200 case, it is more difficult for a bottle 1 to fall over in the display shelf 300.

Although not described here in detail, in another embodied display shelf 300, the rollers 101 at the front portion 310 can be omitted and the bottle can be placed directly on the bottom surface of the shelf main unit. In another embodied display shelf, the rollers 101 can be omitted in all areas. That is, a configuration may also be adopted wherein the bottom surface of a display shelf on which bottles 1 are displayed is inclined from the rear toward the front.

As described above, in the present embodiment of bottle 1, a fall-stopping surface 67 is formed in a position corresponding to the stopper 102, thereby enabling the favorable prevention of falls when bottles are displayed. This type of fall prevention effect is particularly useful for unstable bottles with a small overturn angle in which the center of gravity G is at a relatively high position. Note that the overturn angle refers to the angle of bottle inclination when a bottle begins to fall over. For example, the overturn angle of the bottle 1 described above is approximately 11 degrees.

Concave ribs 22 and 23 are formed above and below the fall-stopping surface 67, thereby reinforcing the part close to the load operating point at the time of impact with the stopper 102. Moreover, the fall-stopping surface 67 is formed in relation to the decompression absorption panel 66, so it is possible to effectively prevent falling over of bottles 1 while securing the decompression absorption effect inherently provided by the decompression absorption panel 66. The fall-stopping surface 67 curves outward from the bottle, and is therefore much more capable of preventing overturns of bottles 1 compared to the case in which the fall-stopping surface 67 does not curve outward. Moreover, because the fall-stopping surface 67 extends horizontally, the contact surface area with the stopper 102 can be made large, enabling the impact load to be distributed.

Figure 11:
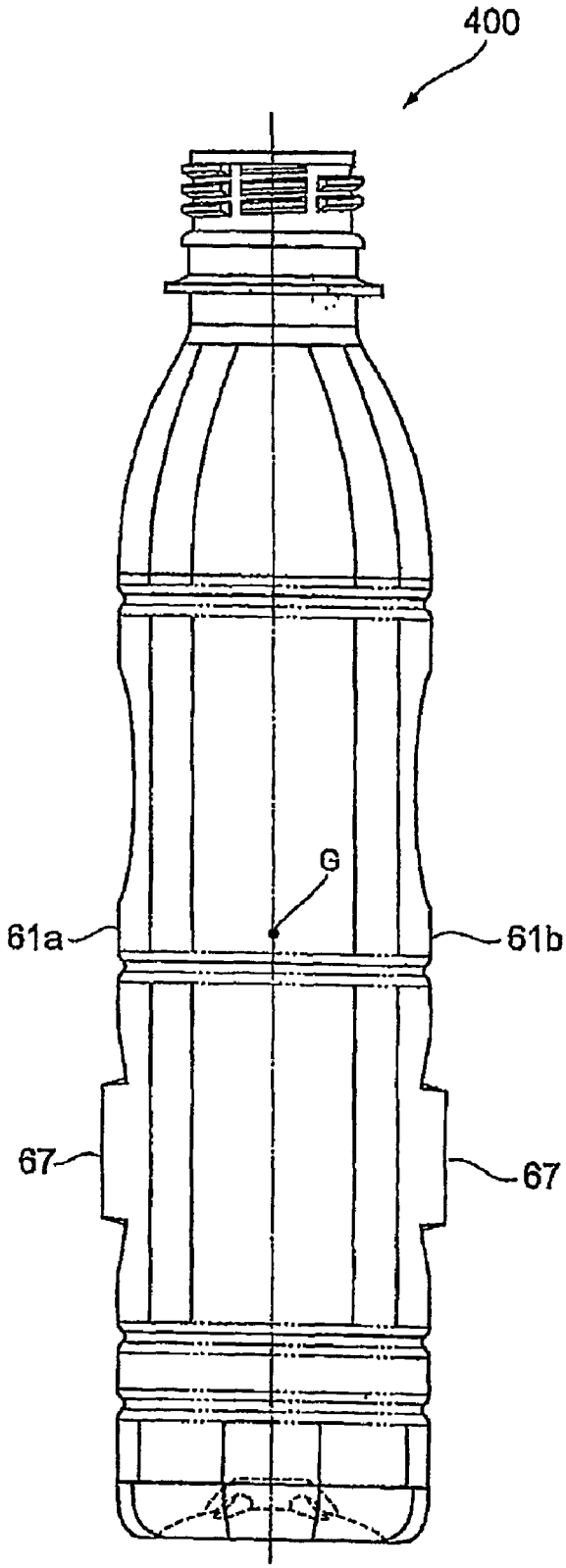
FIG. 11 is a side view of a plastic bottle according to another embodiment of the invention.

Next, referring to FIG. 11, a bottle 400 according to another embodiment is explained. The difference between the bottle 400 and the bottle 1 is the position of the fall-stopping surface 67 in the front-rear direction. In the bottle 400, each of the fall-stopping surfaces 67, 67 on the side walls 61*a* and 61*b* protrudes away from the bottle more than the other outer surfaces of the main unit 3. That is, the fall-stopping surface 67 on the side wall 61*a* is positioned in front of the surface therebelow, and the fall-stopping surface 67 on the sidewall 61*b* is positioned behind the surface therebelow. An effect similar to that of the bottle 1 can be provided even in such a bottle 400. Note that other configurations of the bottle 400 are the same as those of the bottle 1, hence a detailed explanation is here omitted.

It is not necessary for bottles in other embodiments of the present invention to be oblate. For example, the cross-sectional shape 60 may be a circle, oval, square, or other polygon. When the height of the stopper 102 differs from that described above, the position of the fall-stopping surface 67 may also be changed correspondingly. In that case, the non-concave fall-stopping surface 67 can be formed at a height position corresponding to the stopper 102.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A beverage container, comprising:

a main unit configured to contain liquid therein, the main unit having a front surface, the main unit having a concavely formed decompression absorption panel;

a bottom end; and a fall-stopping surface formed on the front surface of the main unit, the fall-stopping surface located at a predetermined position in a range of 20 mm to 70 mm from the bottom end, the fall-stopping surface located within the decompression absorption panel, the fall-stopping surface located at a position in a front-to-back direction the same as or in front of a surface below the fall-stopping surface.

2. The beverage container of claim 1, wherein the fall-stopping surface is formed in a band shape so as to divide the decompression absorption panel into upper and lower parts.

3. The beverage container of claim 2, wherein the fall-stopping surface is flush with other surfaces of the main unit except for the decompression absorption panel.

4. The beverage container of claim 1, further comprising reinforcing concave ribs formed over a perimeter of the main unit on at least an upper side and a lower side of the fall-stopping surface.

5. The beverage container of claim 1, wherein the fall-stopping surface has a height in a vertical direction of 10 mm to 30 mm.

6. The beverage container of claim 1, wherein the fall-stopping surface is curved away from the beverage container.

7. The beverage container of claim 1, wherein the main unit has an approximately rectangular sectional shape having a left-right length being greater than a front-to-back length.

8. The beverage container of claim 7, wherein the fall-stopping surface is formed to extend in a left-right direction at a center portion of the front surface.

9. The beverage container of claim 1, wherein the center of gravity of the beverage container in a liquid-holding state is at a position above the fall-stopping surface.

10. The beverage container of claim 1, wherein the fall-stopping surface is configured to contact a stopper provided at a display shelf at the same time or earlier than a surface below the fall-stopping surface does.

11. The beverage container of claim 1, wherein the container is configured to contain liquid from 300 ml to 800 ml.

12. The beverage container of claim 1, wherein the container has a height of 140 mm to 220 mm.

13. A beverage container comprising:

a main unit configured to hold liquid therein;

a concavely formed decompression absorption panel formed on the main unit; and a fall-stopping surface formed on the main unit, wherein the fall-stopping surface extends in a width direction of the beverage container, and a depth of a part having the fall-stopping surface is the same as or deeper than a depth of a part below the fall-stopping surface, wherein the fall-stopping surface is configured to contact a stopper provided on a display shelf, wherein the fall-stopping surface is formed in a band shape so as to divide the decompression absorption panel into upper and lower parts.

* * * * *